US008899947B2

(12) United States Patent
Lee et al.

(10) Patent No.: US 8,899,947 B2
(45) Date of Patent: Dec. 2, 2014

(54) COMPRESSOR

(75) Inventors: Kangwook Lee, Seoul (KR); Bumdong Sa, Seoul (KR)

(73) Assignee: LG Electronics Inc., Seoul (KR)

( * ) Notice: Subject to any disclaimer, the term of this patent is extended or adjusted under 35 U.S.C. 154(b) by 116 days.

(21) Appl. No.: 13/338,737

(22) Filed: Dec. 28, 2011

(65) Prior Publication Data

US 2012/0171065 A1 Jul. 5, 2012

(30) Foreign Application Priority Data

Dec. 29, 2010 (KR) ..... 10-2010-0138180

(51) Int. Cl.

| | |
|---|---|
| ***F01C 1/02*** | (2006.01) |
| ***F01C 1/063*** | (2006.01) |
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 29/02*** | (2006.01) |
| ***F04C 29/04*** | (2006.01) |
| ***F04B 35/04*** | (2006.01) |
| ***F04B 17/00*** | (2006.01) |
| ***F04C 18/32*** | (2006.01) |
| ***F01C 21/10*** | (2006.01) |
| ***F04C 23/00*** | (2006.01) |
| *F04C 29/06* | (2006.01) |

(52) U.S. Cl.

CPC ..... *F01C 21/10* (2013.01); *F04C 29/06* (2013.01); *F04C 2270/12* (2013.01); *F04C 2240/40* (2013.01); *F04C 18/322* (2013.01); *F04C 29/025* (2013.01); *F04C 23/008* (2013.01); *F04C 2240/804* (2013.01); *Y10S 417/902* (2013.01)

USPC ..... 418/55.1; 418/55.6; 418/63; 418/94; 417/356; 417/410.3; 417/902

(58) Field of Classification Search

USPC ..... 418/66, 91, 94, 102, 228–229, 418/216–218, 63, 83; 417/356, 357, 410.3, 417/902; 184/6, 61; 29/888.025

See application file for complete search history.

(56) References Cited

U.S. PATENT DOCUMENTS

| | | | | |
|---|---|---|---|---|
| 2,122,462 A | | 7/1938 | Fricke | 230/140 |
| 2,415,011 A | * | 1/1947 | Hubacker | 417/256 |

(Continued)

FOREIGN PATENT DOCUMENTS

| | | |
|---|---|---|
| CN | 101135309 | 3/2008 |
| EP | 0 526 145 A2 | 2/1993 |

(Continued)

OTHER PUBLICATIONS

International Search Report and Written Opinion dated May 1, 2012. (PCT/KR2011/010108).

(Continued)

*Primary Examiner* — Kenneth Bomberg
*Assistant Examiner* — Deming Wan
(74) *Attorney, Agent, or Firm* — Ked & Associates, LLP

(57) ABSTRACT

A compressor is provided having an accumulator that forms an accumulating chamber in an internal space of a shell of the compressor, reducing a size of the compressor and simplifying an assembly process. A stationary shaft having a refrigerant suction passage may be directly connected to the accumulator to prevent leakage of refrigerant. Further, a center of gravity of the accumulator may correspond to a center of gravity of the compressor to reduce vibration noise of the compressor caused by the accumulator. Furthermore, both ends of the stationary shaft may be supported by a frame to reduce compressor vibration without using a separate bearing. An installation area of the compressor including the accumulator may be minimized to enhance design flexibility of an outdoor device employing the compressor and minimize interference with other components, thereby facilitating installation of the outdoor device.

3 Claims, 14 Drawing Sheets

(56) References Cited

U.S. PATENT DOCUMENTS

| | | | | |
|---|---|---|---|---|
| 2,420,124 | A | 5/1947 | Coulson | |
| 2,440,593 | A | 4/1948 | Miller | |
| 3,153,334 | A * | 10/1964 | Vutz | 464/32 |
| 4,624,630 | A | 11/1986 | Hirahara et al. | |
| 4,826,408 | A | 5/1989 | Inoue et al. | |
| 5,261,800 | A | 11/1993 | Sakae | |
| 5,295,788 | A * | 3/1994 | Tajima et al. | 416/204 R |
| 5,374,171 | A | 12/1994 | Cooksey | |
| 5,542,831 | A | 8/1996 | Scarfone | |
| 6,213,732 | B1 | 4/2001 | Fujio | 417/312 |
| 6,592,346 | B2 | 7/2003 | Bushnell | |
| 6,817,490 | B2 * | 11/2004 | Petit | 222/321.9 |
| 6,824,367 | B2 | 11/2004 | Matsumoto et al. | |
| 7,344,367 | B2 * | 3/2008 | Manole | 418/173 |
| 7,361,004 | B2 * | 4/2008 | Hwang et al. | 418/59 |
| 7,607,904 | B2 * | 10/2009 | Masuda | 418/62 |
| 2003/0072664 | A1 | 4/2003 | Bushnell | 418/63 |
| 2005/0031465 | A1 | 2/2005 | Dreiman et al. | 417/356 |
| 2006/0127256 | A1 | 6/2006 | Hwang et al. | 418/29 |
| 2006/0159570 | A1 | 7/2006 | Manole | 471/440 |
| 2009/0155111 | A1 * | 6/2009 | Okaichi et al. | 418/29 |
| 2010/0092322 | A1 | 4/2010 | Furusho et al. | 418/63 |
| 2010/0322796 | A1 | 12/2010 | Ko | |

FOREIGN PATENT DOCUMENTS

| | | | |
|---|---|---|---|
| EP | 1 657 444 | A1 | 5/2006 |
| JP | 61-187591 | | 8/1986 |
| JP | 62-284985 | | 12/1987 |
| JP | 63-186988 | | 8/1988 |
| JP | 2000-283074 | | 10/2000 |
| JP | 2002-221156 | | 8/2002 |
| KR | 10-1998-043393 | | 9/1998 |
| KR | 10-1999-0012573 | | 2/1999 |
| KR | 10-0230999 | B1 | 11/1999 |
| KR | 10-1999-0084586 | | 12/1999 |
| KR | 10-2000-0033611 | | 6/2000 |
| KR | 20-2001-0002267 | | 10/2001 |
| KR | 10-2010-0010441 | | 2/2010 |
| WO | WO 2010/010994 | A2 | 1/2010 |
| WO | WO 2010/010996 | | 1/2010 |

OTHER PUBLICATIONS

International Search Report and Written Opinion dated May 1, 2012. (PCT/KR2011/010110).

International Search Report and Written Opinion dated May 1, 2012. (PCT/KR2011/010166).

International Search Report and Written Opinion dated May 1, 2012. (PCT/KR2011/010111).

U.S. Office Action issued in U.S. Appl. No. 13/338,822 dated Sep. 9, 2013.

U.S. Office Action issued in U.S. Appl. No. 13/338,778 dated Sep. 11, 2013.

United States Office Action dated Dec. 2, 2013 issued in U.S. Appl. No. 13/338,480.

U.S. Office Action issued in U.S. Appl. No. 13/338,778 dated Jan. 15, 2014.

U.S. Office Action issued in U.S. Appl. No. 13/338,822 dated Jan. 15, 2014.

Chinese Office Action dated Feb. 7, 2014. (translation).

European Search Report issued in related Application No. 11853206.8 dated Apr. 14, 2014.

U.S. Office Action issued in co-pending U.S. Appl. No. 13/338,605 dated May 9, 2014.

U.S. Office Action issued in co-pending U.S. Appl. No. 13/338,480 dated May 13, 2014.

European Search Report issued in Application No. 11852747.2 dated Jun. 11, 2014.

European Search Report dated Sep. 8, 2014, issued in Application No. 11853555.8.

Notice of Allowance dated Sep. 4, 2014, issued in U.S. Appl. No. 13/338,480.

Office Action dated Oct. 1, 2014, issued in U.S. Appl. No. 13/338,778.

Notice of Allowance dated Aug. 6, 2014, issued in U.S. Appl. No. 13/338,822.

Chinese Office Action dated Sep. 19, 2014, issued in Application No. 201110460468.5 (with English translation).

* cited by examiner

COMPRESSOR

CROSS-REFERENCE TO RELATED APPLICATION(S)

The present application claims priority to Korean Application No. 10-2010-0138180, filed in Korea on Dec. 29, 2010, which is herein expressly incorporated by reference in its entirety.

BACKGROUND

1. Field

A compressor is disclosed herein.

2. Background

Compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
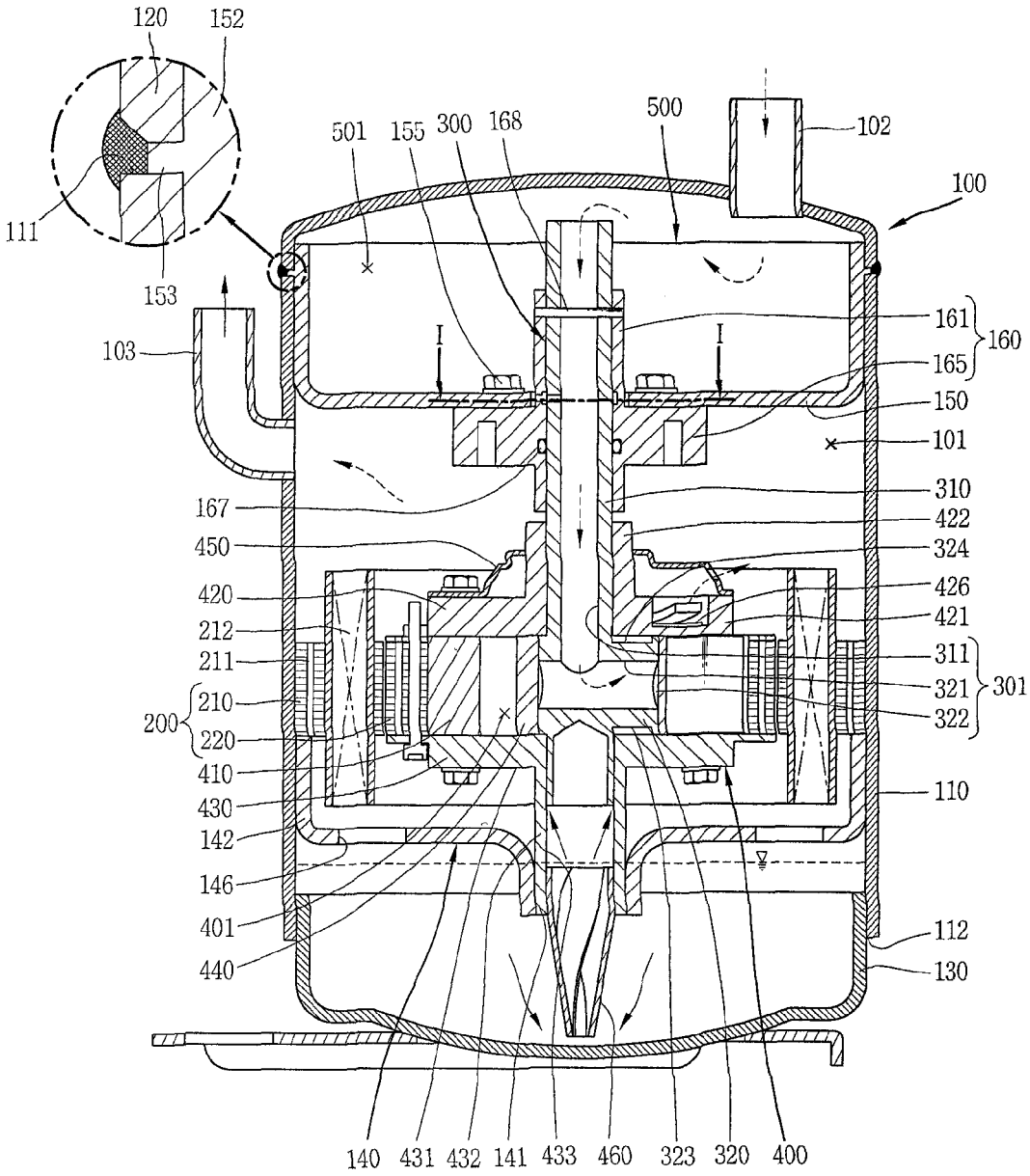
FIG. 1 is a cross-sectional view of a compressor according to an embodiment.

Hereinafter, a compressor according to embodiments will be described in detail with reference to the accompanying drawings. Where possible, like reference numerals have been used to indicate like elements.

In general, a compressor, which may be referred to as a hermetic compressor, may be provided with a drive motor that generates a driving force installed in an internal space of a sealed shell and a compression unit or device operated in combination with the drive motor to compress refrigerant. Compressors may be divided into reciprocating compressors, scroll compressors, rotary compressors, and oscillating compressors according to a method of compressing refrigerant. The reciprocating, scroll, and rotary type compressors use a rotational force of the drive motor; however, the oscillating type compressor uses a reciprocating motion of the drive motor.

In the above-described compressors, a drive motor of the compressor using rotational force may be provided with a crank shaft that transfers the rotational force of the drive motor to the compression device. For instance, the drive motor of the rotary type hermetic compressor (hereinafter, "rotary compressor") may include a stator fixed to the shell, a rotor inserted into the stator with a predetermined gap therebetween and rotated in accordance with an interaction with the stator, and a crank shaft coupled with the rotor to transfer the rotational force of the drive motor to the compression device while being rotated together with the rotator. In addition, the compression device may include a cylinder that forms a compression space, a vein that divides the compression space of the cylinder into a suction chamber and a discharge chamber, and a plurality of bearing members that forms a compression space together with the cylinder while supporting the vein. The plurality of bearing members may be disposed at one side of the drive motor or disposed at both sides thereof, respectively, to provide support in both axial and radial directions, such that the crank shaft may be rotated with respect to the cylinder.

Further, an accumulator, which may be connected to a suction port of the cylinder to divide refrigerant inhaled into the suction port into gas refrigerant and liquid refrigerant and inhale only the gas refrigerant into a compression space, may be installed at a side of the shell. The capacity of the accumulator may be determined according to a capacity of the compressor or cooling system. Further, the accumulator may be fixed by, for example, a band or a clamp at an outer portion of the shell, and may communicate with a suction port of the cylinder through a L-shaped suction pipe, which may be fixed to the shell.

However, in the case of the above-described rotary compressor, the accumulator may be installed at an outer portion of the shell. Thus, a size of the compressor including the accumulator may be increased, thereby increasing a size of an electrical product employing the compressor.

Further, in such a rotary compressor, the accumulator may be connected to a separate suction pipe outside of the shell, and thus, the assembly of the shell and accumulator may be separated from each other, complicating an assembly process while increasing a number of assembly processes. Moreover, a number of connecting portions may be increased, as both sides of the accumulator are connected to the shell through refrigerant pipes, respectively, thereby increasing the possibility of refrigerant leakage.

Furthermore, in such a rotary compressor, an area occupied by the compressor may be increased, because the accumulator is installed outside of the shell, thereby limiting design flexibility when the compressor is mounted, for example, on or to an outdoor device of a cooling cycle apparatus. Also, in such a rotary compressor, the accumulator may be eccentrically disposed with respect to a center of gravity of the entire compressor including the accumulator, and thus, an eccentric load due to the accumulator may occur, as the accumulator is installed outside of the shell, thereby increasing vibration noise of the compressor.

Also, in such a rotary compressor, the crank shaft may be supported at a side of the drive motor and rotated in a radial direction with respect to the drive motor, thereby increasing vibration generated during rotation of the crank shaft. In addition, a length of a bearing that supports the crank shaft in a radial direction may be lengthened to increase an axial directional length of the entire compressor, or a separate bearing member may be required equal to the reduced length of the bearing when reducing the length of the bearing, thereby increasing the fabrication cost.

Also, in such a rotary compressor, a drive motor and a compression device installed at an inner portion of the shell may be installed at both sides of the crank shaft, thereby increasing a total height of the compressor. Due to this, the compressor cannot be installed at a center of the outdoor device, but rather, is installed biased to one side, taking into consideration interference with other components when the compressor is mounted, for example, in an outdoor device of a cooling cycle apparatus. Therefore, a center of gravity of the outdoor device may be eccentrically located to a side at which the compressor is installed, thereby causing inconvenience or spatial restrictions when moving or installing the outdoor device as well as aggravating vibration noise of the entire outdoor device.

Figure 2:
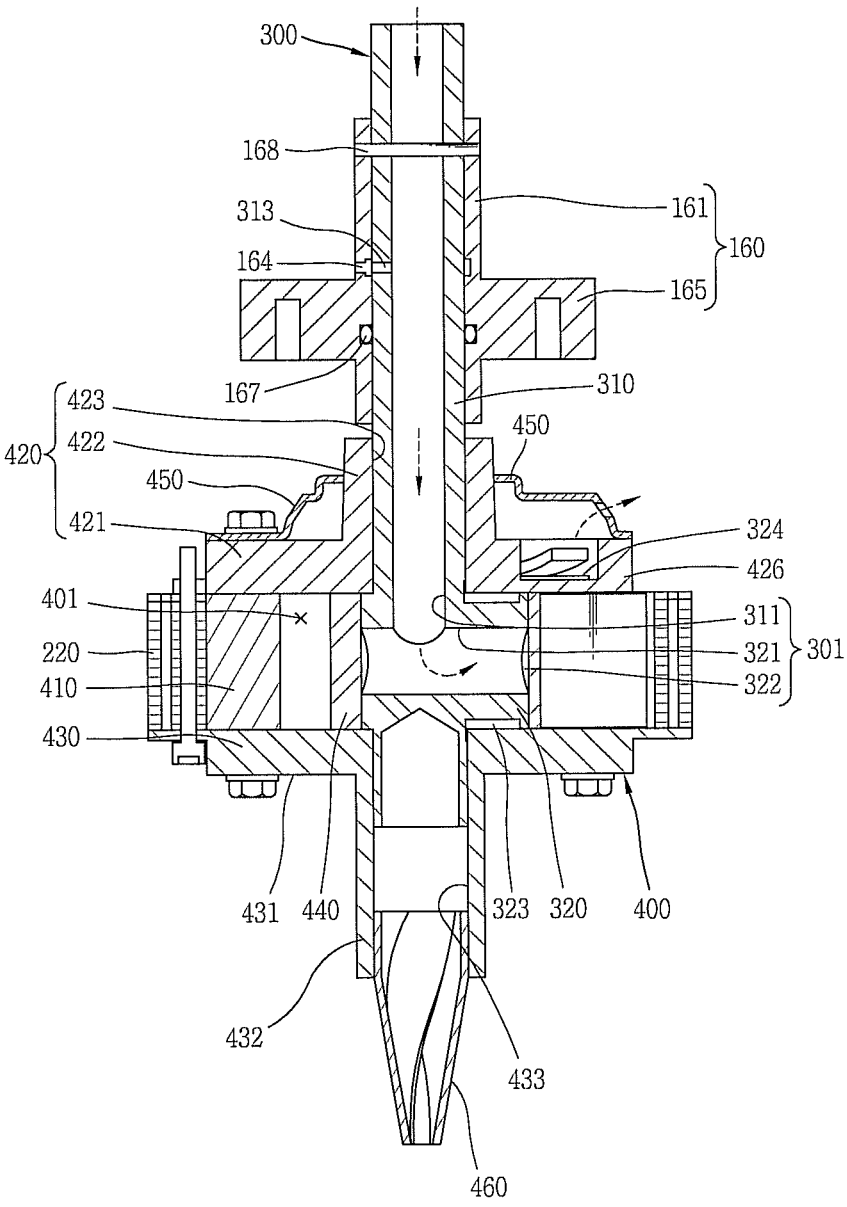
FIG. 2 is a cross-sectional view of a coupling between a stationary shaft and a compression device of the compressor of FIG. 1.
Figure 3:
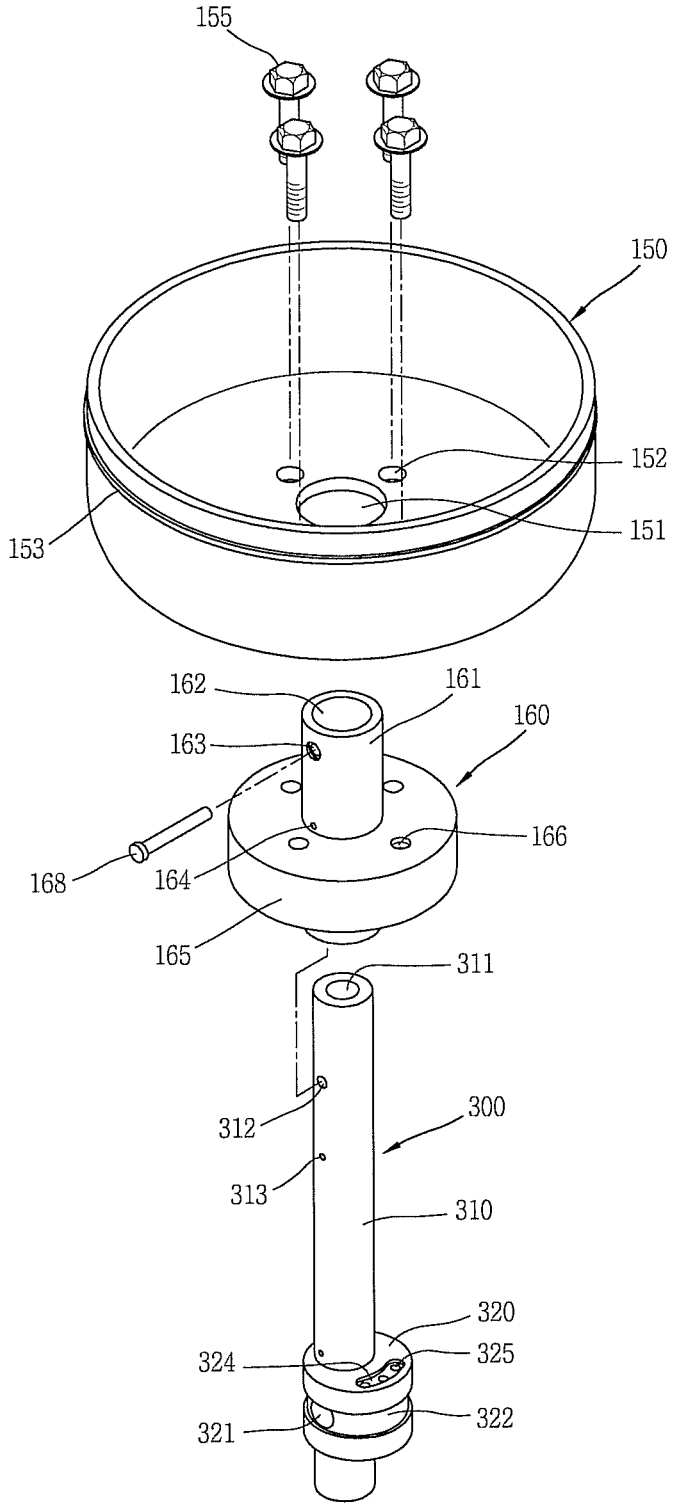
FIG. 3 is an exploded perspective view of an accumulator frame and the stationary shaft in the compressor of FIG. 1.

As illustrated in FIGS. 1 through 3, a compressor, which may be referred to as a hermetic compressor, according to an embodiment may include a drive motor 200 that generates a rotational force installed in an internal space 101 of a sealed shell 100, which may be hermetically sealed, and a stationary shaft 300 fixed in the internal space 101 of the shell 100 at a center of the drive motor 200. The stationary shaft 300 may be rotatably coupled with a cylinder 410 coupled with a rotor 220 of the drive motor 200 to be rotated by the stationary shaft 300. An accumulator 500 having a predetermined accumulating chamber 501 may be provided separated within and from the internal space 101 of the shell 100 and coupled with the stationary shaft 300.

The shell 100 may include a shell body 110, within which the drive motor 200 may be installed, an upper cap 120 that forms an upper surface of the accumulator 500 while covering an upper open end (hereinafter, "first open end") 111 of the shell body 110, and a lower cap 130 that covers a lower open end (hereinafter, "second open end") 112 of the shell body 110. The shell body 110 may be formed in a cylindrical shape. A stator 210, which will be described later, may be fixed to a middle portion of the shell body 110 in, for example, a shrink-fitting manner. Further, a lower frame 140 that supports a lower bearing 430, which will be described later, in a radial direction, as well as the stator 210 may be fixed to the shell body 110 at a lower portion of the stator 210 by, for example, shrink-fitting. The lower frame 140 may include a bearing hole 141, into a center of which the lower bearing 430 may be rotatably inserted to support the stationary shaft 300, which will be described later, in a radial direction. An edge of the lower frame 140 may be bent and formed with a fixing portion that allows an outer circumferential surface thereof to be closely adhered to the shell body 110. An outer front end surface of the lower frame 140, namely, an end of the fixing portion 142, may be closely adhered to a lower surface of the stator 210 and fixed to the shell body 110 to support the stator 210 in an axial direction.

Figure 4:
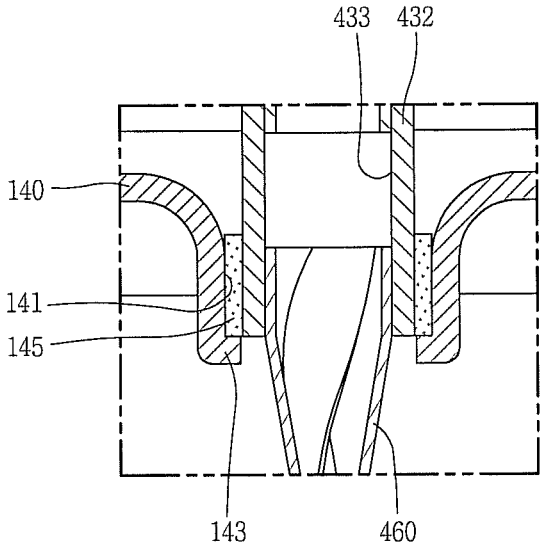
FIG. 4 is a cross-sectional view illustrating an embodiment in which a bearing member is provided between a lower frame and a lower bearing in the compressor of FIG. 1.

The lower frame 140 may be made of, for example, a metal plate or a casting. When the lower frame 140 is made of a metal plate, a separate bearing member 145, such as a ball bearing or bush, may be installed thereon, to provide lubrication between the lower frame 140 and the lower bearing 430, as illustrated in FIG. 4. However, when the lower frame 140 is made of a casting, a bearing hole 141 of the lower frame 140 may be precision processed, and therefore, a separate bearing member may not be required. When the separate bearing member 145 is installed between the lower frame 140 and the lower bearing 430, a bearing support portion 143 may be bent and formed to support the bearing member 145 at an end of the bearing hole 141 of the lower frame 140, as illustrated in FIG. 4.

Figure 5:
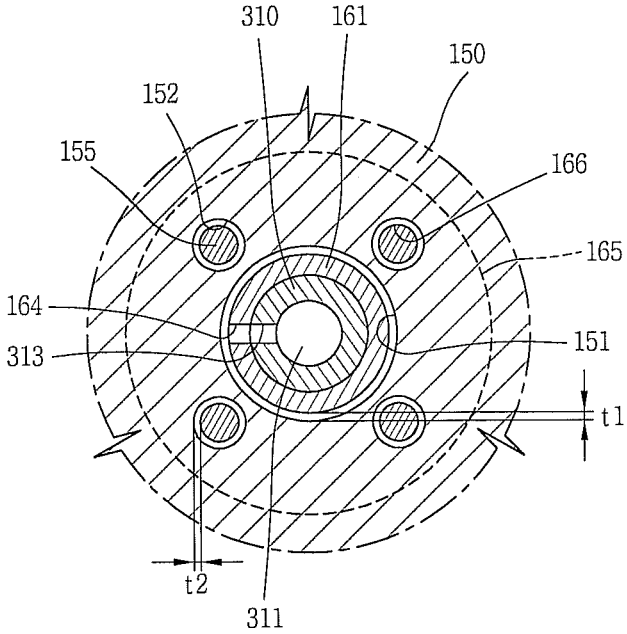
FIG. 5 is a cross-sectional view taken along line I-I of FIG. 1.

An accumulator frame 150, which may form a lower surface of the accumulator 500, may be provided at an upper end of the shell body 110. The accumulator frame 150 may include a bushing hole 151, through a center of which a stationary bushing (upper bush) 160, which will be described later, may penetrate and be coupled therewith. As illustrated in FIG. 5, an inner diameter of the bushing hole 151 may be larger than an outer diameter of the shaft receiving portion 161 of the stationary bushing 160, which will be described later, by a clearance (t1), which may be advantageous during a process of centering the stationary shaft 300, which will be described later.

Further, a one or more through hole(s) 152 configured to fasten the accumulator frame 150 and the stationary bushing 160 by, for example, a bolt 155 may be formed at a periphery of the bushing hole 151, as illustrated in FIG. 5. A diameter of the one or more through hole(s) 152 may be larger than a diameter of for example, the bolt 155 or a diameter of one or more fastening hole(s) 166 provided in the stationary bushing 160 by a clearance (t2), which may be advantageous during the process of centering the stationary shaft 300.

An edge of the accumulator frame 150 may be formed with a fixing portion 153 that extends in a radial direction a length to overlap with the shell body 110 and an end of the upper cap 120. The fixing portion 153 of the accumulator frame 150 may be closely adhered to an inner circumferential surface of the shell body 110 and an inner circumferential surface of the upper cap 120. The fixing portion 153 may be, for example, coupled to the shell body 110 and the end of the upper cap 120 so that the shell body 110, the upper cap 120, and the accumulator frame 150 are joined together, thereby enhancing a sealability of the shell 100. The fixing protrusion 153 may be interposed between the shell body 110 and the end of the upper cap 120, as shown in FIG. 1.

Figure 6:
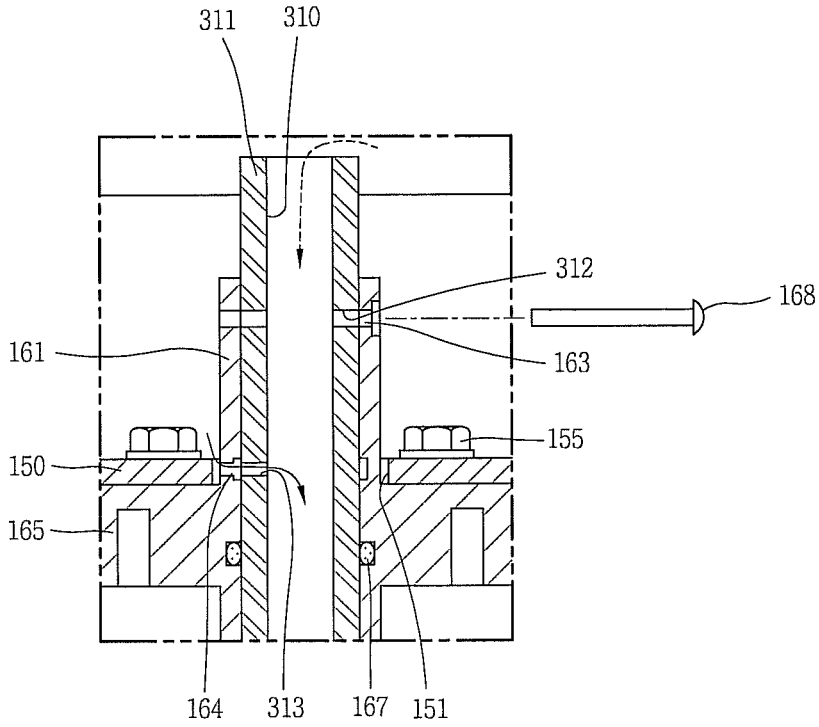
FIG. 6 is a cross-sectional view of a fixing structure of the stationary shaft of the compressor of FIG. 1.

The stationary bushing 160 may include the shaft receiving portion 161, which may be inserted into the bushing hole 151 of the accumulator frame 150, and a flange portion 165 that extends in a radial direction at a middle portion of a circumferential surface of the shaft receiving portion 161. The shaft receiving portion 161 may include a shaft receiving hole 162, through a center of which the stationary shaft 300 may penetrate. A sealing member 167 that provides a seal between the accumulating chamber 501 of the accumulator 500 and the internal space 101 of the shell 100 may be provided at the middle portion of the shaft receiving portion 161. Further, as illustrated in FIGS. 5 and 6, a pin fixing hole 163 may be formed at an upper end side of the shaft receiving portion 161 configured to receive a fixing pin 168 that fastens the stationary shaft 300 within the shaft receiving hole 162. The stationary bushing 160 and the stationary shaft 300 may be fixed using other approximate means, such as a fixing bolt or a fixing ring, other than the above-discussed fixing pin 168. An oil drain hole 164 that collects oil separated from the accumulator 500 into a compression space 401 through a refrigerant suction passage 301 of the stationary shaft 300 may also be formed at the middle portion of the shaft receiving portion 161, namely, at a portion adjacent to the flange portion 165.

The flange portion 165 may be formed such that a radial directional width thereof is larger than a radial directional width of the shaft receiving portion 161, thereby allowing a clearance when the stationary bushing 160 performs a centering operation together with the stationary shaft 300. One or more of the fastening hole(s) 166 may be formed at or in the flange portion 165 to correspond to the one or more through hole(s) 152 of the accumulator frame 150. A diameter of the fastening hole(s) 166 may be smaller than a diameter of the through hole(s) 152.

An edge of the upper cap 120 may be bent to face a first open end 111 of the shell body 110, and may be, for example, welded thereto together with the fixing portion 153 of the accumulator frame 150. Further, a suction pipe 102 that guides refrigerant to the accumulator 500 during a cooling cycle may penetrate and be coupled with the upper cap 120. The suction pipe 102 may be eccentrically disposed to one side of the upper cap 120, so as not to concentrically correspond to the refrigerant suction passage 301 of the stationary shaft 300, which will be described later, thereby preventing liquid refrigerant from being inhaled into the compression space 401. Furthermore, a discharge pipe 103 that guides refrigerant discharged into the internal space 101 of the shell 100 from the compression device 400 may penetrate and be coupled with the shell body 110 between the stator 210 and the accumulator frame 150. An edge of the lower cap 130 may be attached, for example, by welding to a second open end 112 of the shell body 110.

As illustrated in FIG. 1, the drive motor 200 may include a stator 210 fixed to the shell 100 and a rotor 220 rotatably disposed at an inner portion of the stator 210. The stator 210 may include a plurality of ring-shaped stator sheets laminated together to a predetermined height, and a coil 230 wound around a teeth portion provided at an inner circumferential surface thereof. Further, the stator 210 may be, for example, shrink-fitted to be fixed and coupled with the shell body 110 in an integrated manner. A front end surface of the lower frame 140 may be closely adhered and fixed to a lower surface of the stator 210.

An oil collecting hole 211 may be formed adjacent to and penetrate an edge of the stator 210 to pass oil collected in the internal space 101 of the shell 100 through the stator 210 into the lower cap 130. The oil collecting hole 211 of the stator 210 may communicate with an oil collecting hole 146 of the lower frame 140.

The rotor 220, which may include a magnet 212, may be disposed at an inner circumferential surface of the stator 210 with a predetermined gap therebetween and may be coupled with the cylinder 410, which will be described later, at a center thereof. The rotor 220 and cylinder 410 may be coupled with an upper bearing plate (hereinafter, abbreviated as an "upper bearing") 420 and/or the lower bearing plate (hereinafter, abbreviated as a "lower bearing") 430, which will be described later, by, for example, a bolt. The rotor 220 and cylinder 410 may be molded in an integrated manner using, for example, a sintering process.

As illustrated in FIGS. 1 through 3, the stationary shaft 300 may include a shaft portion 310 having a predetermined length in an axial direction, both ends of which may be fixed to the shell 100, and an eccentric portion 320 that extends eccentrically at a middle portion of the shaft portion 310 in a radial direction and which is accommodated in the compression space 401 of the cylinder 410 to vary a volume of the compression space 401. The shaft portion 310 may be formed such that a center of the stationary shaft 300 corresponds to a rotational center of the cylinder 410 or a rotational center of the rotor 220 or a radial center of the stator 210 or a radial center of the shell 100, whereas the eccentric portion 320 may be formed such that the center of the stationary shaft 300 is eccentrically located with respect to the rotational center of the cylinder 410 or the rotational center of the rotor 220 or the radial center of the stator 210 or the radial center of the shell 100.

An upper end of the shaft portion 310 may be inserted into the accumulating chamber 501 of the accumulator 500, whereas a lower end of the shaft portion 310 may penetrate in an axial direction and be rotatably coupled with the upper bearing 420 and the lower bearing 430 to support the same in a radial direction.

A first suction guide hole 311, an upper end of which may communicate with the accumulating chamber 501 of the accumulator 500 to form the refrigerant suction passage 301, may be formed at an inner portion of the shaft portion 310 and having a predetermined depth in an axial direction, so as to extend nearly to a lower end of the eccentric portion 320, and a second suction guide hole 321, an end of which may communicate with the first suction guide hole 311 and the other end of which may communicate with the compression space 401, to form the refrigerant suction passage 301 together with the first suction guide hole 311, may penetrate the eccentric portion 320 in a radial direction.

As illustrated in FIG. 6, a pin hole 312 may penetrate an upper side portion of the shaft portion 310, in particular, at a position corresponding to the pin fixing hole 163 of the stationary bushing 160, in a radial direction to allow the fixing pin 168 to pass therethrough, and an oil drain hole 313 that collects oil in the accumulator 500 may be formed at a lower side of the pin hole 312, for example, at a height lower than a height of the bushing hole 151 and a bottom surface of the accumulator frame 150, to communicate with the first suction guide hole 311.

Figure 7:
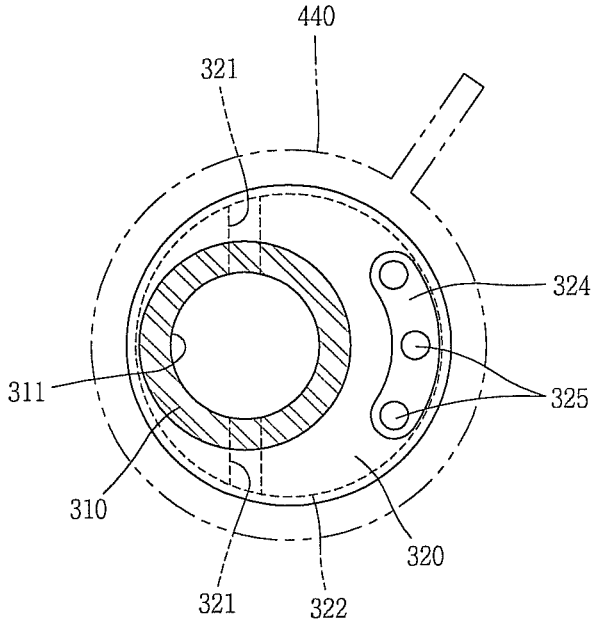
FIG. 7 is a plan view of an eccentric portion of the stationary shaft of the compressor of FIG. 1.

The eccentric portion 320 may be formed in a disc shape having a predetermined thickness, as illustrated in FIG. 7, and thus, may be eccentrically formed with respect to a center of the shaft portion 310 in a radial direction. An eccentric amount of the eccentric portion 320 may be sufficiently large according to a capacity of the compressor, as the shaft portion 310 is fixed to and coupled with the shell 100.

The second suction guide hole 321, which may form the refrigerant suction passage 301 together with the first suction guide hole 311, may penetrate an inner portion of the eccentric portion 320 in a radial direction. A plurality of second suction guide holes 321 may be formed in a straight line, as shown in FIG. 7; however, according to other circumstances, for example, the second suction guide hole 321 may penetrate and be formed in only one direction with respect to the first suction guide hole 311.

A suction guide groove 322 may be formed, for example, in a ring shape, at an outer circumferential surface of the eccentric portion 320 to communicate refrigerant at all times with a suction port 443 of the roller vein 440, which will be described later, through the second suction guide hole 321. Alternatively, suction guide groove 322 may also be formed at an inner circumferential surface of the roller vein 440, or may be formed at both an inner circumferential surface of the roller vein 440 and an outer circumferential surface of the eccentric portion 320. Further, the suction guide groove 322 may not necessarily be in a ring shape, but rather, may also be formed in a long circular arc shape in a circumferential direction, for example. Other shapes of the suction guide groove 322 may also be appropriate.

Figure 8:
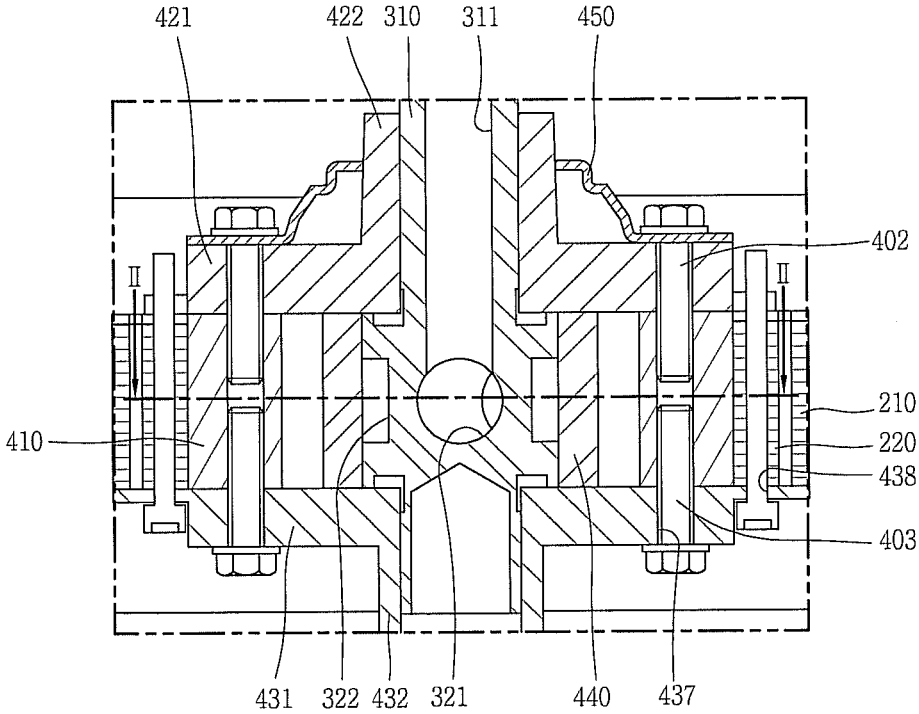
FIG. 8 is a cross-sectional view of the compression device in the compressor of FIG. 1.
Figure 9:
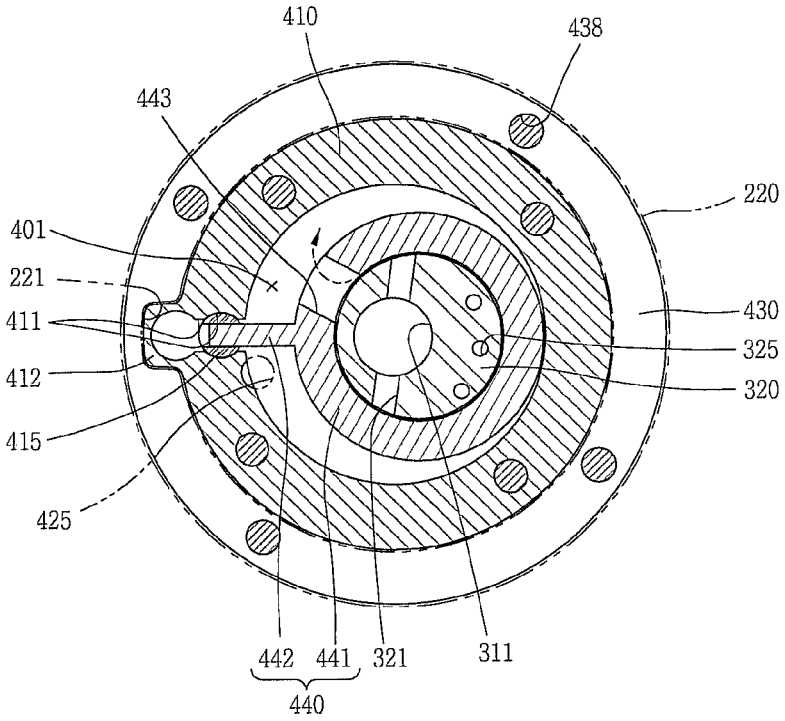
FIG. 9 is a cross-sectional view taken along line II-II of FIG. 8.

The compression device 400 may be coupled with the eccentric portion 320 of the stationary shaft 300 to compress refrigerant while being rotated together with the rotor 220. As illustrated in FIGS. 8 and 9, the compression device 400 may include the cylinder 410, the upper bearing 420 and the lower bearing 430 positioned at both sides of the cylinder 410, respectively, to form the compression space 401, and the roller vein 440 provided between the cylinder 410 and the eccentric portion 320 to compress refrigerant while varying the compression space 401.

The cylinder 410 may be formed in a ring shape to form the compression space 401 therewithin. A rotational center of the cylinder 410 may be provided to correspond to an axial center of the stationary shaft 300. Further, a vein slot 411, into which the roller vein 440 may be slidably inserted in a radial direction while being rotated, may be formed at a side of the cylinder 410. The vein slot 411 may be formed in various shapes according to the shape of the roller vein. For example, a rotation bush 415 may be provided in the vein slot 411, such that a vein portion 442 of the roller vein 440 may be rotationally moved in the vein slot 411, when a roller portion 441 and the vein portion 442 of the roller vein 440 are formed in an integrated manner, as illustrated in FIG. 9. Further, the vein slot 411 may be formed in a slide groove shape, such that the vein portion 442 may be slidably moved in the vein slot 411 when the roller portion 441 and vein portion 442 are rotatably coupled with each other.

An outer circumferential surface of the cylinder 410 may be inserted into the rotor 220 and coupled therewith in an integrated manner. For example, the cylinder 410 may be pressed to the rotor 220 or fastened to the upper bearing 420 or the lower bearing 430 using, for example, fastening bolts 402, 403.

When the cylinder 410 and upper bearing 420 are fastened by or to the lower bearing 430, an outer diameter of the lower bearing 430 may be formed larger than that of the cylinder 410, whereas an outer diameter of the upper bearing 420 may be formed to be approximately similar than that of the cylinder 410. Further, a first through hole 437 configured to fasten the cylinder 410 and a second through hole 438 configured to fasten the rotor 220 may be formed, respectively, on the lower bearing 430. The first through hole 437 and second through hole 438 may be formed on radially different lines to enhance a fastening force, but may be also formed on the same line based on assembly considerations. A fastening bolt 402 may pass through the lower bearing 430 and be fastened to the cylinder 410 and a fastening bolt 403 may pass through the upper bearing 420 (via first through hole 427) and be fastened to the cylinder 410. The fastening bolts 402 and 403 may be formed to have the same fastening depth.

Figure 10:
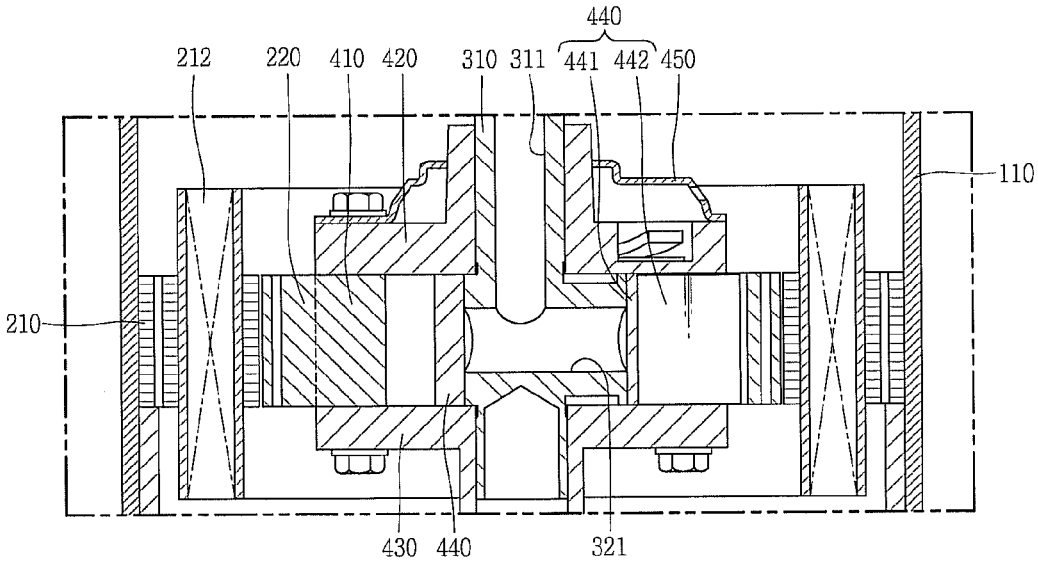
FIG. 10 is a cross-sectional view of a coupling between a cylinder and a rotor of the compressor of FIG. 1, according to another embodiment.

The cylinder 410 may be molded together with the rotor 220 in an integrated manner, as illustrated in FIG. 10. For example, the cylinder 410 and rotor 220 may be molded in an integrated manner through, for example, a powder metallurgy or die casting process. In this case, the cylinder 410 and rotor 220 may be formed using the same material, or different materials. When the cylinder 410 and rotor 220 are formed using different materials, the cylinder 410 may be formed of a material having a relatively high abrasion resistance in comparison to the rotor 220. Further, when the cylinder 410 and rotor 220 are formed in an integrated manner, the upper bearing 420 and the lower bearing 430 may be formed to have the same or a smaller outer diameter than that of the cylinder 410, as illustrated in FIG. 10.

As illustrated in FIG. 9, a protrusion portion 412 and a groove portion 221 may be formed at an outer circumferential surface of the cylinder 410 and an inner circumferential surface of the rotor 220, respectively, to enhance a combining force between the cylinder 410 and the rotor 220, as illustrated in FIG. 9. The vein slot 411 may be formed within a range of a circumferential angle formed by the protrusion portion 412 of the cylinder 410. A plurality of protrusion portions and groove portions may be provided. When a plurality of protrusion portions and groove portions are provided, they may be formed at a same interval along the circumferential direction to cancel out magnetic unbalance.

Figure 11:
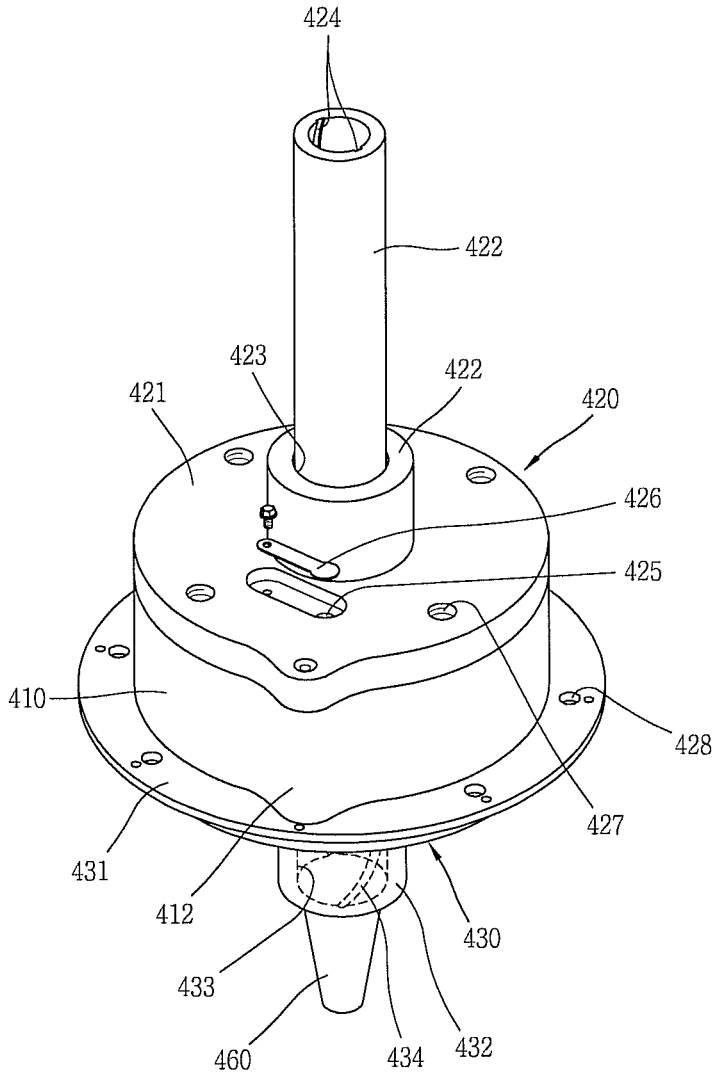
FIG. 11 is a perspective view of the compression device of the compressor of FIG. 1.

As illustrated in FIG. 11, the upper bearing 420 may be formed such that a shaft receiving portion 422 that supports the shaft portion 310 of the stationary shaft 300 in a radial direction protrudes upward a predetermined height at a center of an upper surface of the stationary plate portion 421. The rotor 220, the cylinder 410, and a rotating body including the upper bearing 420 and the lower bearing 430, which will be described later, may have a rotational center corresponding to an axial center of the stationary shaft 300. Thus, the rotating body may be efficiently supported even though the shaft receiving portion 422 of the upper bearing 420 or the shaft receiving portion 432 of the lower bearing 430 do not have a long length.

The stationary plate portion 421 may be formed in a disc shape and may be fixed to an upper surface of the cylinder 410. A shaft receiving hole 423 of the shaft receiving portion 422 may be formed to be rotatably coupled with the stationary shaft 300. An oil groove 424, which will be described later, may be formed in, for example, a spiral shape at an inner circumferential surface of the shaft receiving hole 423.

A discharge port 425 may be formed at a side of the shaft receiving portion 422 to communicate with the compression space 401, and a discharge valve 426 may be formed at an outlet end of the discharge port 425. A muffler 450 that reduces discharge noise of refrigerant being discharged through the discharge port 425 may be coupled with an upper side of the upper bearing 420.

As illustrated in FIGS. 8 and 11, the lower bearing 430 may be formed to be symmetrical to the upper bearing 420, such that a shaft receiving portion 432 that supports the shaft portion 310 of the stationary shaft 300 in a radial direction protrudes downward a predetermined height at a center of a lower surface of the stationary plate portion 431. The rotor 220, the cylinder 410, and the rotating body including the upper bearing 420 and the lower bearing 430 may have a rotational center corresponding to an axial center of the stationary shaft 300, and thus, the rotating body may be efficiently supported even though the shaft receiving portion 432 of the lower bearing 430 does not have as long a length as the shaft receiving portion 422 of the upper bearing 420.

The stationary plate portion 431, which may be formed in a disc shape, may be fixed to a lower surface of the cylinder 410, and a shaft receiving hole 433 of the shaft receiving portion 432 may be formed to be rotatably coupled with the stationary shaft 300. An oil groove 434, which will be described later, may be formed in a spiral shape at an inner circumferential surface of the shaft receiving hole 433.

When the cylinder 410 and rotor 220 are separately formed, the rotor 220 and the cylinder 410 may be coupled with each other by means of a stationary plate portion 431 of the lower bearing 430. Of course, the cylinder 410 and rotor 220 may be coupled in an integrated manner by means of the upper bearing 420.

The accumulator 500 may be formed separated within and from the internal space 101 of the shell 100, as the accumulator frame 150 is sealed and coupled with an inner circumferential surface of the shell body 110, as described above. For the accumulator frame 150, an edge of a circular plate body may be bent and an outer circumferential surface thereof attached to, for example, welded and coupled with a joint portion between the shell body 110 and the upper cap 120, while being closely adhered to an inner circumferential surface of the shell body 110 and an inner circumferential surface of the upper cap 120, to seal the accumulating chamber 501 of the accumulator 500.

A compressor having the foregoing configuration according to embodiments may be operated as follows.

When the rotor 220 is rotated by applying power to the stator 210 of the drive motor 200, the cylinder 410 coupled with the rotor 220 through the upper bearing 420 or the lower bearing 430 may be rotated with respect to the stationary shaft 300. Then, the roller vein 440 slidably coupled with the cylinder 410 may generate a suction force as it divides the compression space 401 of the cylinder 410 into a suction chamber and a discharge chamber.

Then, refrigerant may be inhaled into the accumulating chamber 501 of the accumulator 500 through the suction pipe 102, and the refrigerant divided into gas refrigerant and liquid refrigerant in the accumulating chamber 501 of the accumulator 500. The gas refrigerant may be inhaled into the suction chamber of the compression space 401 through the first suction guide hole 311 and second suction guide hole 321 of the stationary shaft 300, the suction guide groove 322, and the suction port 443 of the roller vein 440. The refrigerant inhaled into the suction chamber may be compressed while being moved to the discharge chamber by the roller vein 440 as the cylinder 410 continues to be rotated, and discharged to the internal space 101 of the shell 100 through the discharge port 425. The refrigerant discharged to the internal space 101 of the shell 100 may repeat a series of processes before being discharged to a cooling cycle apparatus through the discharge pipe 103. At this time, oil in the lower cap 130 may be pumped by oil feeder 460 provided at a lower end of the lower bearing 430, while the lower bearing 430 is rotated at high speed together with the rotor 220, and passed sequentially through the oil groove 434 of the lower bearing 430, the bottom oil pocket 323, the oil through hole(s) 325, the top oil pocket 324, the oil groove 424 of the upper bearing 420, to be supplied to each sliding surface.

Hereinafter, an assembly sequence of a compressor according to embodiments will be described.

In a state that the stator 210 and the lower frame 140 of the drive motor 200 are fixed to the shell body 110 in, for example, a shrink-fitting manner, the stationary shaft 300 may be inserted into the stationary bushing 160 to be fixed by means of, for example, the fixing pin 168. The rotor 220, the cylinder 410, and both the bearings 420, 430 may be coupled with the stationary shaft 300.

Next, in a state of maintaining a concentricity of the stator 210 and the rotor 220, the accumulator frame 150 may be inserted into the shell body 110 to fasten the stationary bushing 160 to the accumulator frame 150, and the accumulator frame 150 may be, for example, three-point welded to the shell body 110 for a temporary fix. Then, the lower cap 130 may be pressed to the second open end 112 of the shell body 110, and a joint portion between the lower cap 130 and the shell body 110 may be, for example, circumferentially welded to be sealed.

Next, the upper cap 120 may be, for example, pressed to the upper open end 111 of the shell body 110, and a joint portion between the upper cap 120 and the shell body 110 may be, for example, circumferentially welded together with the accumulator frame 150 to seal the internal space 101 of the shell 100, while forming the accumulating chamber 501 of the accumulator 500.

As described above, a portion of the internal space of the shell may be used for the accumulator, which may be installed separated within and from the internal space of the shell, thereby reducing a size of the compressor including the accumulator.

Further, an assembly process of the accumulator and an assembly process of the shell may be unified to simplify an assembly process of the compressor. Further, an accumulating chamber of the accumulator may be directly connected to a refrigerant suction passage of the stationary shaft by coupling the stationary shaft with the accumulator to prevent leakage of refrigerant from occurring, thereby enhancing compressor performance. Furthermore, an area required for installing the compressor may be minimized when installing the compressor including the accumulator in an outdoor device, thereby enhancing design flexibility of the outdoor device. A center of gravity of the accumulator may be placed at a location corresponding to that of the entire compressor including the accumulator, thereby reducing vibration noise of the compressor due to the accumulator. Also, an eccentric portion for forming a compression space in the stationary shaft may be provided, while an axial center of the stationary shaft corresponds to a rotational center of the cylinder, thereby securing a spacious compression space and increasing compressor capacity.

Further, the stator and lower frame may be, for example, shrink-fitted at the same time to be fixed to the shell, thereby preventing the shell from being thermally deformed in a non-uniform manner while the concentricity of the stator is distorted, as well as allowing the lower frame to support a bottom surface of the stator to more securely fix the stator. Both ends of the stationary shaft may be supported by a frame fixed to the shell in a radial direction, thereby effectively suppressing movement of the stationary shaft due to vibration generated during rotation of the rotational body, as well as enhancing durability and reliability of the compressor, although a separate bearing is not installed between the stationary shaft and rotational body or the bearing is used to the minimum.

Interference with other components due to the compressor may be minimized to allow the compressor having a weight relatively higher than that of other components to be installed at the center of gravity of an outdoor device, thereby facilitating movement and installation of the outdoor device.

Another embodiment of an accumulator in a compressor will be described hereinbelow.

Figure 12:
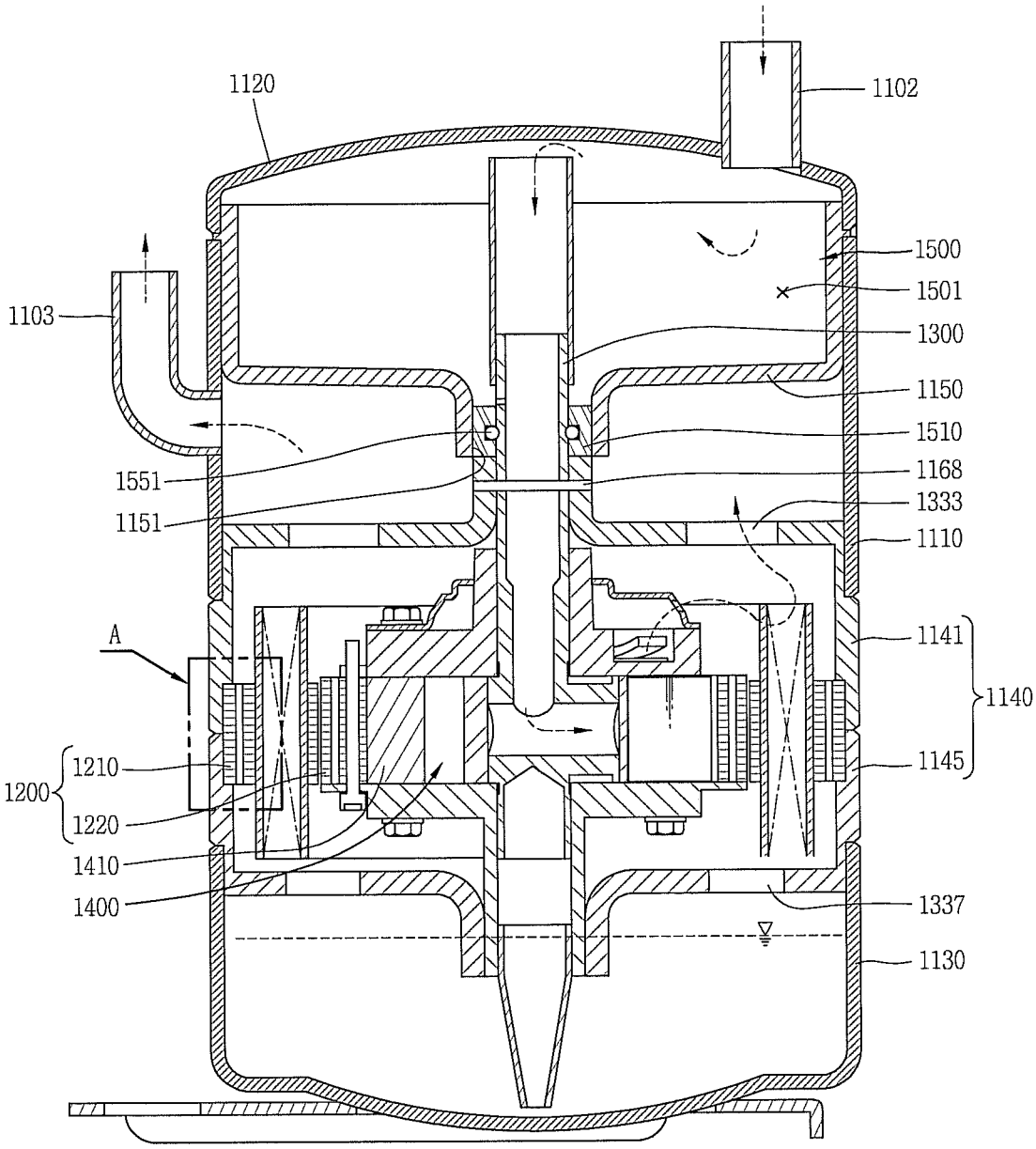
FIG. 12 is a cross-sectional view of a compressor according to another embodiment.

According to the foregoing embodiment, the stator 210 and the accumulator frame 150 may be fixed in, for example, a shrink-fitting manner at the same time to an inner circumferential surface of the shell 100; however, according to this embodiment, the stator 1210 may be inserted and fixed to the shell 1100, as illustrated in FIG. 12.

That is, the shell 1100 may include an upper shell 1110 and a lower shell 1130, and a middle shell 1140 located between the upper shell 1110 and lower shell 1130. The drive motor 1200 and compression device 1400 may be installed together in the middle shell 1140, and the driving shaft 1300 may penetrate and be coupled with the middle shell 1140.

The upper shell 1110 may be formed in a cylindrical shape, and a lower end thereof may be coupled with an upper frame 1141 of the middle shell 1140, which will be described later, whereas an upper end thereof may be coupled with an upper cap 1120. Further, a suction pipe 1102 may be coupled with the upper shell 1110, and an accumulator frame 1150 may be coupled with an inner circumferential surface of the upper shell 1110 to form an accumulating chamber 1501 of the accumulator 1500 together with the upper cap 1120.

A bushing hole 1151 may be formed at a center of the accumulator frame 1150. A sealing bushing 1510 may be provided between an inner circumferential surface of the bushing hole 1151 and an outer circumferential surface of the stationary shaft 1300. A sealing member 1551 may be inserted into an inner circumferential surface of the sealing bushing 1510 to seal the accumulating chamber 1501 of the accumulator 1500.

The bushing hole 1151 may protrude and extend downward in the form of a burr. Further, an upper end of the stationary shaft 1300 may be positioned adjacent to an upper surface of the accumulator frame 1150. A separate extension pipe 1310 may be connected to an upper end of the stationary shaft 1300. The separate extension pipe 1310 may have an inner diameter greater than that of the stationary shaft 1300 (i.e., an inner diameter of the refrigerant suction passage) to reduce suction loss.

The lower shell 1130 may be formed in, for example, a cup shape, such that an upper end thereof is open and a lower end thereof closed. The open upper end may be coupled with a lower frame 1145, which will be described later.

Figure 13:
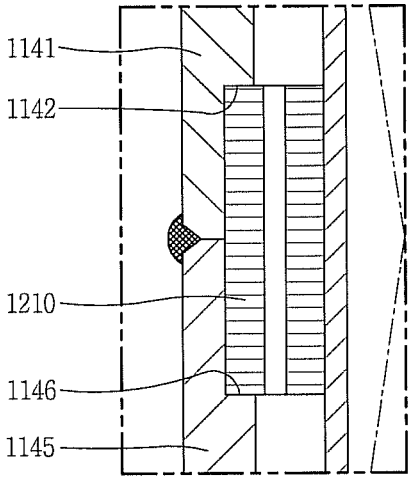
FIG. 13 is an enlarged cross-sectional view of a stator fixing structure of the compressor of FIG. 12.

The middle shell 1140 may be divided into an upper frame 1141 and a lower frame 1145 with respect to the stator 1210 of the drive motor 1200. Further, as illustrated in FIG. 13, grooves 1142, 1146 may be formed at a bottom end of the upper frame 1141 and a top end of the lower frame 1145, respectively, that face each other, which allow lateral surfaces of the stator 1210 to be inserted and supported thereby. Furthermore, a communication hole 1333 that guides refrigerant discharged from the compression device 1400 may be formed on the upper frame 1141, and an oil hole 1337 that collects oil may be formed on the lower frame 1145.

The other basic configuration and working effects thereof in the compressor according to this embodiment as described above may be substantially the same as the foregoing embodiment. However, according to this embodiment, the stator 1210 may be inserted and fixed between the upper frame 1141 and the lower frame 1145 forming part of the shell, and thus, easily assembled based on a concentricity between the stator 1210 and driving shaft 1300. In other words, according to this embodiment, the stator 1210 may be mounted on the groove 1146 of the lower frame 1145, then the driving shaft 1300 coupled with the rotor 1220 and the cylinder 1410 inserted into the stator 1210, and the upper frame 1141 inserted onto the stationary shaft 1300 to support an upper surface of the stator 1210 via the groove 1142 of the upper frame 1141. The upper frame 1141 and lower frame 1145 may be attached, for example, welded, and coupled with each other, and the upper shell 1110 coupled with the accumulator frame 1150 may be inserted onto the upper frame 1141, which may be attached, for example, welded to the upper shell 1110. At this time, prior to attaching the upper frame 1141 to the lower frame 1145, a gap maintaining member, such as a gap gauge, may be inserted between the stator 1210 and the rotor 1220, and then the upper shell 1110 may be adjusted in a radial direction. As a result, the stationary shaft 1300 may maintain a concentricity with respect to the stator 1210. Accordingly, components may be easily assembled based on a concentricity of the stationary shaft when compared to the method of fastening and fixing the stationary bush to the accumulator frame while adjusting the stationary bush in a radial direction in a state in which the gap maintaining member is inserted between the stator and rotor, as described.

According to this embodiment, the stationary shaft 1300 may be supported in an axial direction with respect to the upper frame 1141 using a stationary member 1168, such as a fixing pin, a fixing bolt, or a fixing ring, that passes through the upper frame 1141 and stationary shaft 1300. However, the stationary shaft 1300 may be supported in an axial direction by supporting a lower end of the bush hole 1151 of the accumulator frame 1150 with the upper frame 1141. In this case, the sealing bush 1510 may be, for example, pressed and fixed to the bush hole 1151 of the accumulator frame 1150, and the stationary shaft 1300 may be pressed to the sealing bush 1510 or fixed by using another stationary member.

Still another embodiment of a compressor will be described hereinbelow.

According to the foregoing embodiment, the accumulator includes an accumulating chamber which uses a portion of the shell, namely, an upper cap, but according to this embodiment, the accumulator may be formed to have a separate accumulating chamber in the internal space of the shell and coupled with an inner circumferential surface of the shell to be separated by a predetermined distance.

Figure 14:
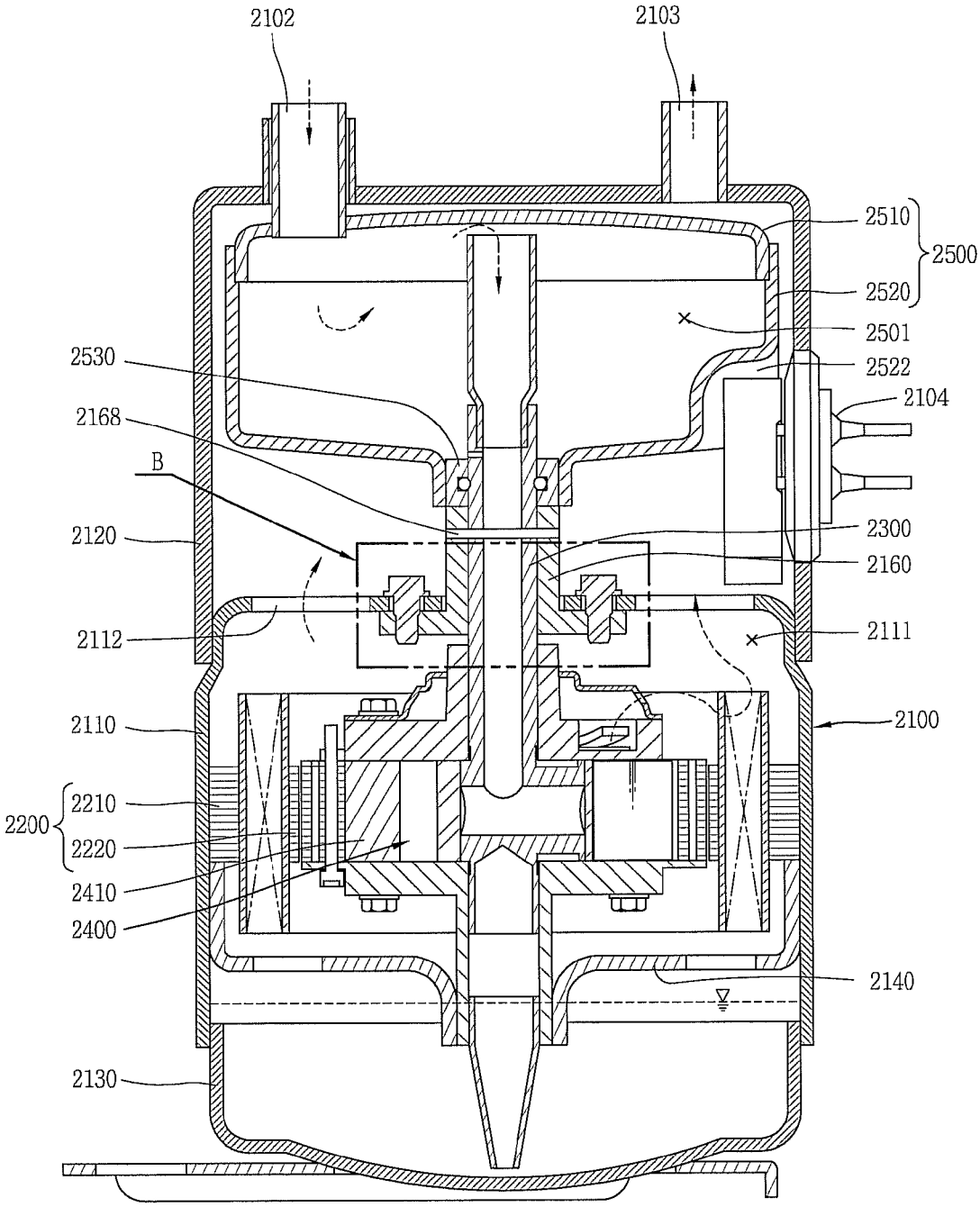
FIG. 14 is a cross-sectional view of a compressor according to another embodiment.

As illustrated in FIG. 14, according to this embodiment, the drive motor 2200 and compression device 2400 may be installed in the shell body 2110, a lower end of which may be open to form part of the shell 2100. A lower end of the shell body 2110 may be sealed by lower cap 2130. A top shell 2120 may be coupled with an upper end of the shell body 2110, and a communication hole 2112 may be formed at an upper surface of the shell body 2110, such that an internal space 2111 of the shell body 2110 may communicate with an internal space 2121 of the top shell 2120. Further, the stationary shaft 2300 may be inserted into a center of the shell body 2110 to fasten the stationary bushing 2160 by means of, for example, a fixing pin 2168. The accumulator 2500 separated by a predetermined distance to have a separate accumulating chamber 2501 in the internal space of the top shell 2120 may be coupled with an upper end of the stationary shaft 2300. The accumulator 2500 may be fixed to the shell by means of a suction pipe 2102 that passes through the top shell 2120 and is coupled therewith.

Figure 15:
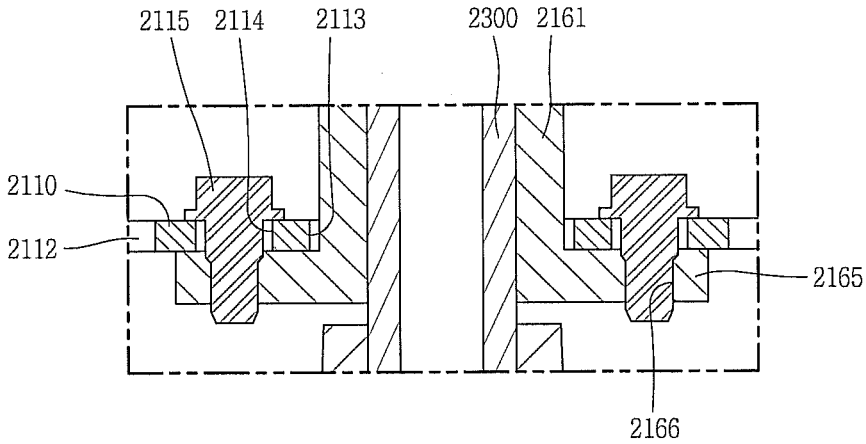
FIG. 15 is a cross-sectional view of an assembly structure of a stationary bush that controls concentricity to a stationary shaft in the compressor of FIG. 14.

As illustrated in FIG. 15, the bushing hole 2113 may be formed at or in the shell body 2110 to pass through the shaft receiving portion 2161 of the stationary bushing 2160, and the through hole 2114 configured to fasten the stationary bushing 2160 with the bolt 2115 may be formed adjacent to the bushing hole 2113. Further, a fastening hole 2166 may be formed at a flange portion 2165 of the stationary bushing 2160 to correspond to the through hole 2114.

An inner diameter of the bushing hole 2113 may be larger than that of the shaft receiving portion 2161, while a diameter of the through hole 2114 may larger than that of the fastening hole 2166, thereby facilitating assembly based on a concentricity of the stationary shaft 2300. Further, the stator 2210 of the drive motor 2200 may be, for example, shrink-fitted and fixed to the shell body 2110, and the lower frame 2140, which supports a lower end of the stationary shaft 2300 while at the same time supporting the stator 2210, may be, for example, shrink-fitted and fixed to a lower end of the stator 2210. A discharge pipe 2103 that communicates with the internal space 2121 of the top shell 2120 to discharge compressed refrigerant to a cooling cycle apparatus may be coupled with a surface through which the suction pipe 2102 penetrate.

The accumulator 2500 may be coupled with the upper housing 2510 and the lower housing 2520 to be sealed to each other to form an accumulating chamber 2501, which may be separated from the internal space 2121 of the top shell 2120. A bushing hole 2521 may be formed at a center of the lower housing 2520, and a sealing bushing 2530 inserted into the stationary shaft 2300 may be fixed to the bushing hole 2521.

Figure 16:
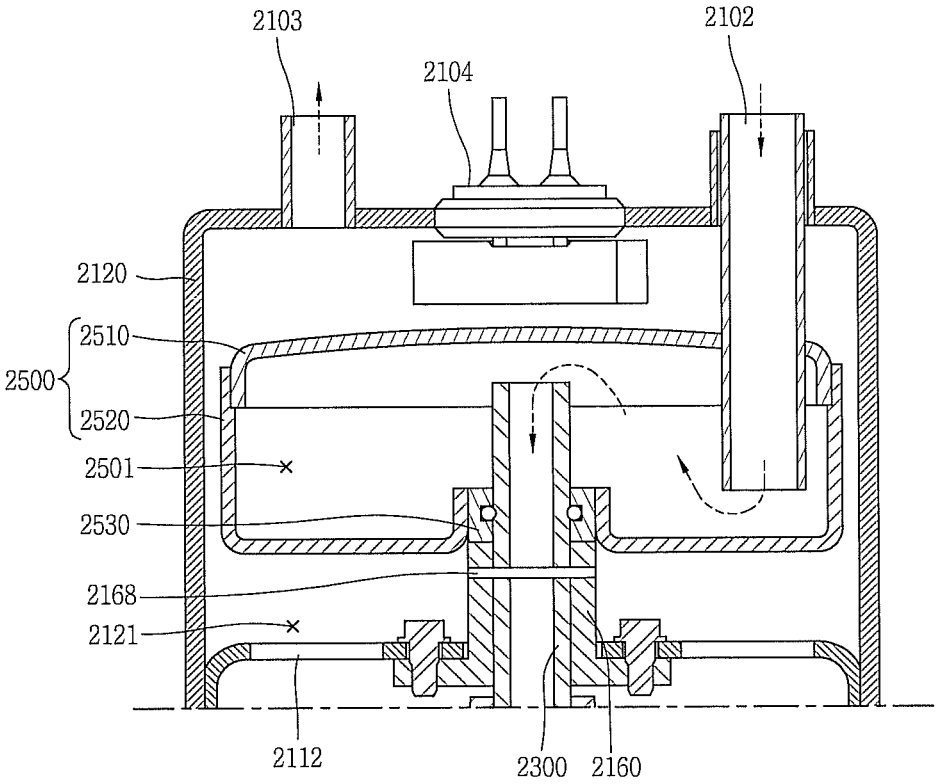
FIG. 16 is a cross-sectional view of an assembly position of a terminal in the compressor of FIG. 14.

A terminal mounting portion 2522 may be formed in a depressed manner, such that a terminal 2104 may be coupled with a side wall surface of the top shell 2120. The terminal 2104 may be installed at an upper surface of the top shell 2120, according to circumstances, as illustrated in FIG. 16. In this case, a separate terminal mounting portion may not be necessarily formed at a side wall surface of the accumulator 2500, and the sealing bushing 2130 may be disposed to be accommodated into the accumulating chamber 2501 of the accumulator 2500, thereby preventing a height of the compressor from being increased due to the terminal 2104.

The other basic configuration and working effects thereof in a compressor according to this embodiment as described above may be substantially the same as the foregoing embodiment. However, according to this embodiment, as the accumulator 2500 is separated from the shell 2100, heat transferred through the shell 2100 may be prevented from being directly transferred to a suction refrigerant, and vibration due to a pulsating pressure generated when absorbing refrigerant may be prevented from being transferred to the shell.

In addition, the rotor 2220 and cylinder 2410 including the stationary shaft 2300 may be located at an inner portion of the stator 2210 and the stationary bushing 2160 fastened to the shell body 2110 based on a concentricity of the stationary shaft 2300, thereby facilitating assembly based on a concentricity between the stationary shaft 2300 and stator 2210. Moreover, the suction pipe 2102, the discharge pipe 2103, and the terminal 2104 may be disposed on the same plane, thereby further reducing an area occupied by the compressor and further enhancing the design flexibility of the outdoor device.

Still another embodiment of a compressor will be described hereinbelow.

In other words, according to the foregoing embodiment, the accumulator may be installed to form an internal volume using a portion of the shell at an inner portion of the shell or may be separated from an inner circumferential surface of the shell by a predetermined distance to separately form an internal volume, but according to this embodiment, the accumulator may be installed to form an internal volume using the shell at an outer portion of the shell.

Figure 17:
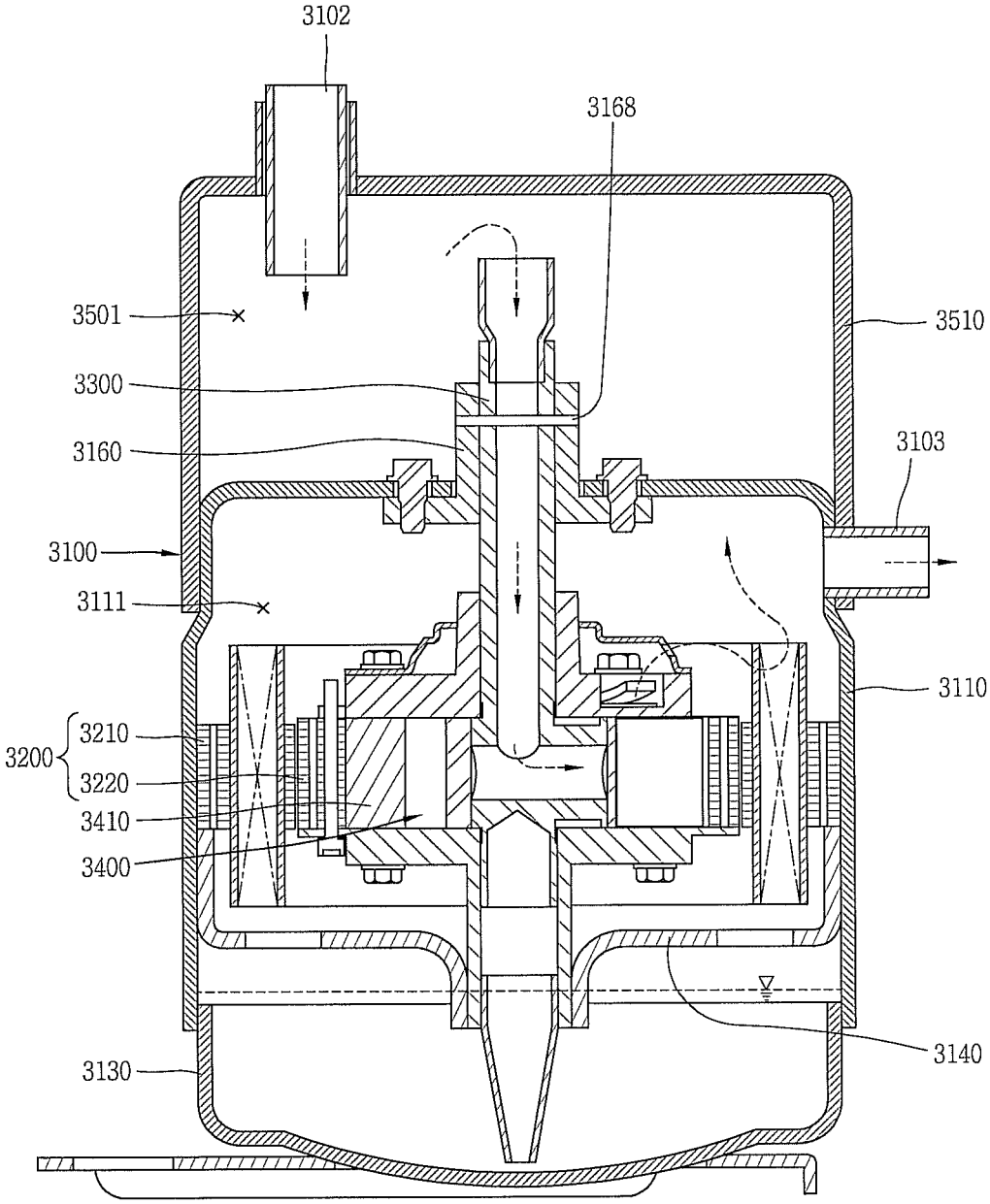
FIG. 17 is a cross-sectional view of a compressor according to still another embodiment.

As illustrated in FIG. 17, according to this embodiment, the drive motor 3200 and compression device 3400 may be installed in the shell body 3110, a lower end of which may be open to form part of the shell 3100, and a lower end of the shell body 3110 may be sealed by the lower cap 3130. Further, an accumulator shell 3510 may be coupled with an upper end of the shell body 3110 to form the accumulator 3500, and an upper surface of the shell body 3110 may be formed in a sealed shape to separate the internal space 3111 of the shell body 3110 from the accumulating chamber 3501 of the accumulator shell 3510. A stationary bushing 3160 inserted and fixed by the stationary shaft 3300 may be fastened to a center of the shell body 3110, and the stationary shaft 3300 may be supported in an axial direction by, for example, a fixing pin 3168 that passes through the stationary shaft 3300 and the stationary bush 3160 in a radial direction.

Further, a suction pipe 3102 may communicate and be coupled with an upper surface of the accumulator shell 3510, and a discharge pipe 3103 that discharges refrigerant discharged from the compression space of the compression device 3400 to a cooling cycle apparatus may communicate and be coupled with a radial directional surface of the shell body 3110.

The stator 3210 of the drive motor 3200 may be, for example, shrink-fitted and fixed to the shell body 3110, and the lower frame 3140, which supports a lower end of the stationary shaft 3300 while at the same time supporting the stator 3210, may be, for example, shrink-fitted and fixed to a lower end of the stator 3210.

The other basic configuration and working effects thereof in a compressor according to this embodiment as described above may be substantially the same as the foregoing embodiment. However, according to this embodiment, the accumulator shell 3510 forming the accumulator 3500 may be coupled with an outer surface of the shell body 3110 forming the shell to facilitate the assembly of the accumulator, and moreover, the rotor 3220 and cylinder 3410 including the stationary shaft 3300 may be located at an inner portion of the stator 3210, and then, the stationary bushing 3160 may be fastened to the shell body 3110 based on an concentricity of the stationary shaft 3300 to facilitate the assembly based on a concentricity between the stationary shaft 3300 and stator 3210.

In addition, a thickness of the accumulator shell 3510 forming the accumulator 3500 may be formed less than that of the shell body 3110 and the lower cap 3130, and a height of the shell 3100 having a relatively higher thickness may be decreased to reduce a weight of the entire compressor. Further, as the accumulator 3500 is installed at an outer portion of the shell 3100, refrigerant inhaled into the accumulating chamber 3501 may be quickly dissipated, thereby reducing a specific volume of the inhaled refrigerant and enhancing compressor performance.

Still another embodiment of a compressor will be described hereinbelow.

Figure 18:
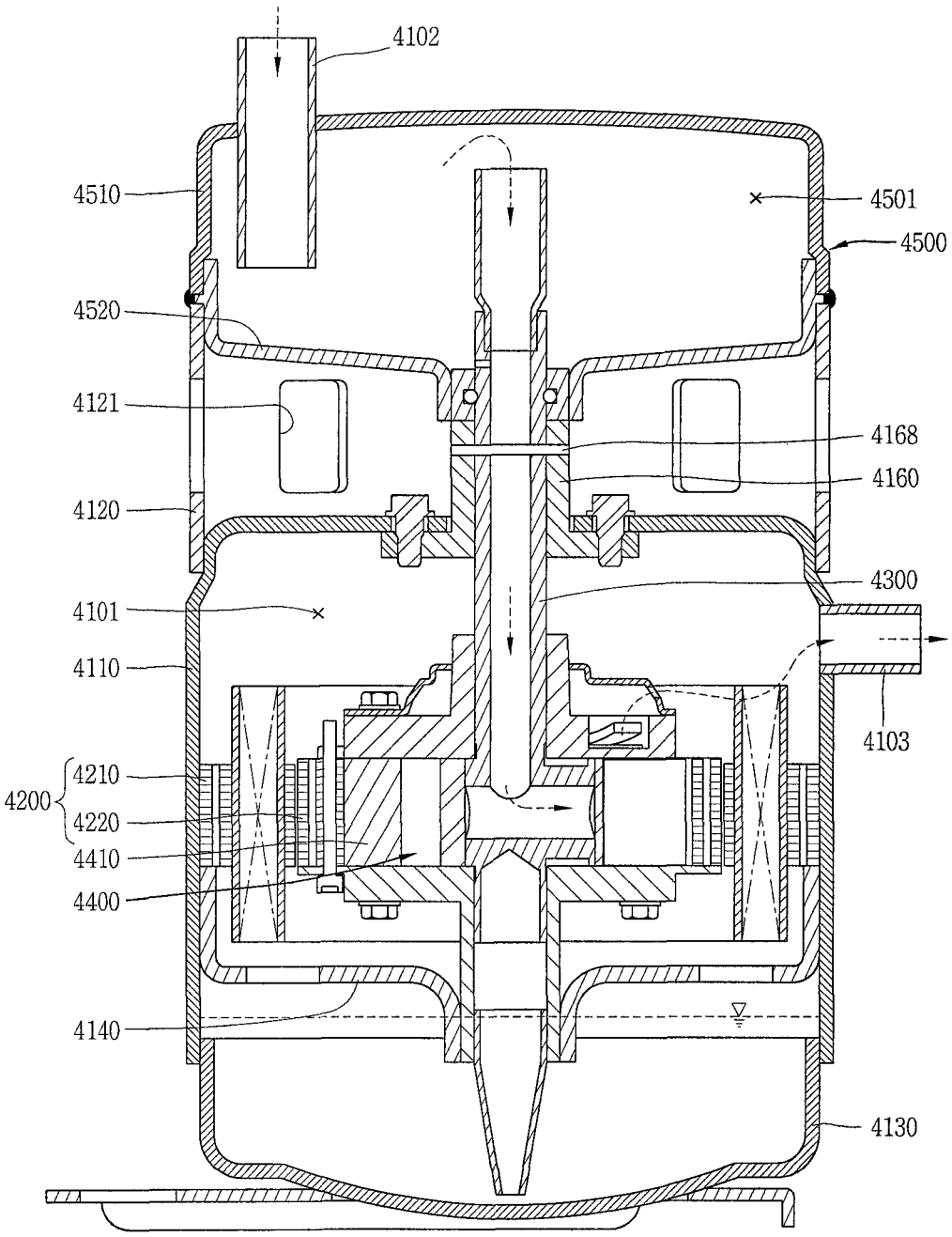
FIG. 18 is a cross-sectional view of a compressor according to still another embodiment.

In other words, according to the foregoing embodiment of FIG. 17, the accumulator may be formed at an outer portion of the shell using an outer surface of the shell to form an accumulating chamber, but according to this embodiment, the accumulator may be installed to have a predetermined distance at an outer portion of the shell. As illustrated in FIG. 18, according to this embodiment, the drive motor 4200 and compression device 4400 may be installed in the shell body 4110, a lower end of which may be open to form part of the shell 4100, and a lower end of the shell body 4110 may be sealed by lower cap 4130.

Further, an accumulator 4500 having a separate accumulating chamber 4501 may be disposed at an upper side of the shell body 4110 to have a predetermined distance, and an upper end of the stationary shaft 4300 may be coupled with the accumulator 4500. Furthermore, the accumulator 4500 may be coupled with an upper shell 4120, which may be inserted and coupled to an outer circumferential surface of the upper side of the shell body 4110. The upper shell 4120 may be formed in a cylindrical shape, such that both opening ends thereof are coupled with the shell body 4110 and accumulator 4500, respectively, for example, by welding. As an upper end of the shell body 4110 is formed in a closed shape, a plurality of through holes 4121 may be formed to allow an internal space formed by the upper shell 4120 to communicate with the outside.

Further, a stationary bushing 4160 inserted and fixed by the stationary shaft 4300 may be fastened to a center of the shell body 4110, and the stationary shaft 4300 may be supported by, for example, a fixing pin 4168 that passes through the stationary shaft 4300 and the stationary bushing 4160 in a radial direction.

The upper housing 4510 and the lower housing 4520 may be sealed to each other to form an accumulating chamber 4501 separated from the internal space 4101 of the shell 4100. Further, a suction pipe 4102 may communicate and be coupled with an upper surface of the accumulator 4500, and a discharge pipe 4103 that discharges refrigerant from the compression space of the compression device 4400 to a cooling cycle apparatus may communicate and be coupled with a radial directional surface of the shell body 4110. The suction pipe 4102 may not necessarily communicate with an upper surface of the accumulator 4500, but may also be installed to communicate in parallel with the discharge pipe 4103. In addition, the discharge pipe 4103 may not necessarily communicate with a side wall surface of the shell body 4110, but may also communicate with an upper surface of the shell body 4110.

The stator 4210 of the drive motor 4200 may be, for example, shrink-fitted and fixed to the shell body 4110, and the lower frame 4140, which may support a lower end of the stationary shaft 4300 while at the same time supporting the stator 4210, may be, for example, shrink-fitted and fixed to a lower end of the stator 4210.

The other basic configuration and working effects in a compressor according to the embodiment described above may be substantially the same as the foregoing embodiment. However, according to this embodiment, the accumulator 4500 may be installed to be separated from the shell body 4100 by a predetermined distance, thereby preventing heat generated by the shell body 4100 from being transferred to refrigerant being inhaled into an accumulating chamber of the accumulator 4500, and through this, a specific volume of the refrigerant being inhaled into a compression space of the compression device 4400 may be prevented from being increased, thereby enhancing compressor performance.

Embodiments disclosed herein provide a compressor in which an accumulating chamber of the accumulator may be formed using an internal space of the shell to reduce a size of the compressor including the accumulator, thereby reducing a size of an electrical product employing the compressor. Further, embodiments disclosed herein provide a compressor in which an assembly process of the accumulator and an assembly process of the shell may be unified to simplify an assembly process of the compressor, as well as reduce a number of connecting portions during assembly of the accumulator to prevent leakage of refrigerant from occurring.

Additionally, embodiments disclosed herein provide a compressor in which an area required to install the compressor in an outdoor device is minimized, as the compressor includes an accumulator, thereby enhancing design flexibility of the outdoor device. Further, embodiments disclosed herein provide a compressor in which a center of gravity of the accumulator is placed at a location corresponding to a center of gravity of the entire compressor including the accumulator, thereby reducing vibration noise of the compressor due to the accumulator.

Furthermore, embodiments disclosed herein provide a compressor in which both ends of the shaft are supported with respect to the drive motor, thereby reducing a length of the bearing or effectively supporting the shaft while using a small number of bearings. Additionally, embodiments disclosed herein provide a hermetic compressor in which interference with other components is minimized when installing the compressor including an accumulator in an outdoor device, thereby allowing the compressor having a weight relatively higher than that of other components to be installed at a center of gravity of the outdoor device.

Embodiments disclosed herein provide a compressor that may include a shell fixed with a stator; a stationary shaft configured to support a compression unit or device combined with a rotor; an upper support member provided at an upper side of the compression unit to support an upper portion of the stationary shaft; a lower support member provided at a lower side of the compression unit to support a lower portion of the stationary shaft; and an accumulator fixed to the stationary shaft at an upper side of the upper support member The stationary shaft may be supported in an axial direction by a fixing member passing through the stationary shaft and the upper support member in a radial direction to be fixed to the shell.

Embodiments disclosed herein provided a compressor that may include a shell having a sealed internal space; a stator fixed and installed at an internal space of the shell; a rotor provided at an inside of the stationary shaft to be rotated; a cylinder combined with the rotor to be rotated therewith; a plurality of bearing plates that covers both top and bottom sides of the cylinder to form a compression space together with the cylinder and combined with the cylinder to be rotated therewith; a stationary shaft fixed to an internal space of the shell, a shaft center formed to correspond to a rotational center of the cylinder, and an eccentric portion of which is formed to vary a volume of the compression space during the rotation of the cylinder while supporting the bearing plates in an axial direction; a suction passage formed to guide refrigerant into the compression space; and an accumulator having a predetermined accumulating chamber separate from an internal space of the shell, in which a suction pipe communicates with the accumulating chamber. An end of the stationary shaft may be inserted into the accumulating chamber of the accumulator to be fixed to the accumulator.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a shell having an inner space and a stator fixed in the inner space;

a stationary shaft configured to support a compression device coupled with a rotor, the stationary shaft having a suction passage formed therein in communication with the compression device;

an upper bushing provided above the compression device that supports an upper portion of the stationary shaft;

a lower frame provided below the compression device that supports a lower portion of the stationary shaft;

an accumulator provided within the shell and coupled to the stationary shaft above the upper bushing; and a fixing pin that passes through the stationary shaft and the upper bushing, oriented in a radial direction of the stationary shaft, such that the stationary shaft is supported in an axial direction by the fixing pin, wherein the accumulator comprises an accumulator frame coupled to the shell such that the accumulator frame forms an accumulator chamber together with the shell, within the inner space of the shell, that is in communication with the suction passage of the stationary shaft.

2. The compressor of claim 1, wherein an outer circumferential surface of each of the upper bushing and the lower frame is fixed to the shell, and wherein the upper bushing comprises a shaft receiving portion adjustably coupled to a flange portion, wherein the stationary shaft is inserted through the flange portion and the shaft receiving portion and coupled to the shaft receiving portion by the fixing pin.

3. The compressor of claim 1, wherein the accumulator frame partitions the accumulator chamber from a remaining portion of the inner space of the shell.

* * * * *